US005881356A

United States Patent [19]

Schneider et al.

[11] Patent Number: 5,881,356

[45] Date of Patent: Mar. 9, 1999

[54] METHOD FOR THE CASE-HARDENING OF HIGHER-MOLYBDENUM-ALLOY SINTERED STEELS

[75] Inventors: Rudolf Schneider, Froendenberg; Bernhard Schelb, Koenigswinter, both of Germany

[73] Assignee: BT-Magnettechnologie GmbH, Herne, Germany

[21] Appl. No.: 776,756

[22] PCT Filed: May 25, 1996

[86] PCT No.: PCT/DE96/00916

§ 371 Date: Feb. 6, 1997

§ 102(e) Date: Feb. 6, 1997

[87] PCT Pub. No.: WO96/41031

PCT Pub. Date: Dec. 19, 1996

[30] Foreign Application Priority Data

Jun. 7, 1995 [DE] Germany ..... 195 20 354.2

[51] Int. Cl.[6] ..... C22C 33/02

[52] U.S. Cl. ..... 419/29

[58] Field of Search ..... 419/29

[56] References Cited

U.S. PATENT DOCUMENTS

| | | | |
|---|---|---|---|
| 3,658,604 | 4/1972 | Haele | 149/126 |
| 3,897,618 | 8/1975 | Church | 29/420.5 |
| 3,992,763 | 11/1976 | Haynie et al. | 29/420.5 |
| 4,018,632 | 4/1977 | Schmidt | 148/126 |
| 4,071,382 | 1/1978 | Riopelle | 148/126 |
| 4,880,461 | 11/1989 | Uchida | 75/238 |
| 4,964,980 | 10/1990 | Greetham | 75/241 |
| 5,252,119 | 10/1993 | Nishida et al. | 75/236 |

FOREIGN PATENT DOCUMENTS

| | | |
|---|---|---|
| 1133499 A | 3/1957 | France . |
| 1942213 A | 2/1970 | Germany . |
| 2053842 A | 5/1971 | Germany . |
| 2038882 A | 7/1980 | United Kingdom . |

*Primary Examiner*—Daniel J. Jenkins
*Attorney, Agent, or Firm*—Venable; George H. Spencer

[57] ABSTRACT

The invention relates to a method for the case-hardening of higher-molybdenum-alloy sintered steels.

It is provided that, immediately after the sintering, the sintered steels are cooled down to a temperature range at which a minimum portion of γ-iron is present in sintered steel and that the sintered steels are subjected to a heat treatment in this temperature range in the presence of carbon.

5 Claims, 1 Drawing Sheet

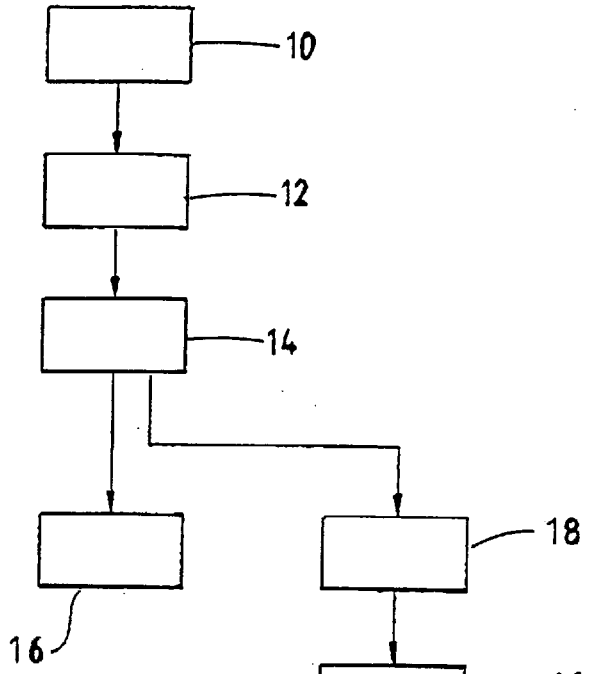
Fig. 1
Fig. 2
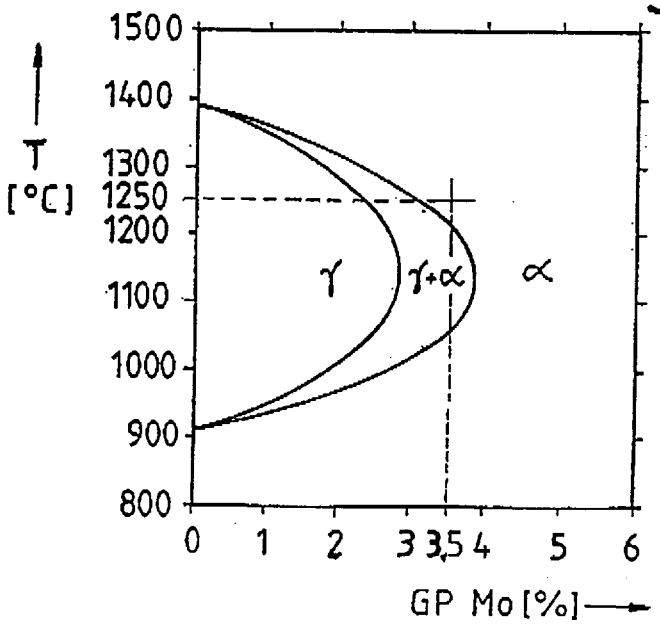

METHOD FOR THE CASE-HARDENING OF HIGHER-MOLYBDENUM-ALLOY SINTERED STEELS

The invention relates to a method for the case-hardening of higher-molybdenum alloy sintered steels.

Prior Art

It is known to produce shaped bodies of any desired geometry from metallic powders, for example, from steel powders, by means of sintering. During this process, the metallic powders are heat-treated below a specific temperature which is just below the melting point of the sintered materials. During the heat treatment of sintered steels, regions having different lattice structures are known to form in which appear so-called α-iron, γ-iron or a mixed structure comprised of α-iron and γ-iron. Conventional sintered steels, which usually comprise carbon, sinter in the region of the γ-iron. Here, the sintering process proceeds $10^2$ to $10^3$ times slower than in the α-iron region at the same temperature. If, for example, steel powders having an elevated molybdenum content are sintered, the sintering occurs at sintering temperatures of approximately 1250° C. in the region of the α-iron. Since an entirely carbon-pure sintering must take place, a drawback of this process is that, during a subsequently required case-hardening, a carbon pick-up in the edge regions of the shaped sintered body is possible only with difficulty and, as a result, a brittle carbide network develops.

ADVANTAGES OF THE INVENTION

But, in contrast, the method according to the invention having the features listed in claim 1, offers the advantage that higher-molybdenum-alloy sintered steels can be case-hardened without resulting in the development of a brittle carbide network. Since, after sintering, the sintered steels are subjected to a heat treatment in the presence of carbon at temperatures at which a minimum portion of γ-iron is present in the sintered steel, it is possible in an advantageous manner to create such a lattice structure, in particular, in the edge regions of the sintered steel, which lattice structure is subsequently suited for the pick-up of carbon. The additional heat treatment is carried out in one working step immediately following the sintering, with the protective gas atmosphere or the vacuum present during the sintering being replaced by a carbon-emitting agent, that is, carbon-containing atmosphere.

In the method according to the invention, cooling takes place from the higher sintering temperature down to the temperature range of the two-phase region in which a minimum portion of γ-iron is present. It is therefore necessary for the case-hardening of sintered steels that a minimum portion of γ-iron be present. If heating up starting from room temperature would take place, the supply of carbon during the heating up would have to be blocked because, also below the two-phase region, only α-iron is present (see FIG. 2) and the harmful iron carbide would develop in this region. Consequently, a long heating phase would be required which ultimately represents idle processing time. To avoid this idle time, cooling takes place from the sintering temperature down to the temperature of the two-phase region (α-iron and γ-iron). Thus, the thermal energy supplied during sintering is utilized at the same time.

If the heat treatment is carried out preferably at a temperature of 1120° C., approximately 40% of the material volume of the higher-molybdenum-alloy sintered steel is comprised in the necessary lattice structure region of the γ-iron if the molybdenum content is 3.5 wt %. This favors the initial pick-up of carbon.

A preferred embodiment of the invention provides that, apart from the additional heat treatment after sintering, a case-hardening is subsequently conducted at the usual case-hardening temperatures of 840° to 950° C. This accomplishes that by means of the additional heat treatment carried out between sintering and case-hardening, an activation of the higher-molybdenum-alloy sintered steel occurs so that the incorporation of carbon becomes possible without resulting in the development of a brittle carbide network.

Further advantageous embodiments of the invention ensue from the remaining features listed in the dependent claims.

DRAWING

In the following, the invention is explained in greater detail by way of an embodiment with reference to the associated drawings. These show: FIG. 1 a block diagram of the method for the case-hardening of higher-molybdenum-alloy sintered steels and FIG. 2 a phase diagram of molybdenum-alloy sintered steels.

DESCRIPTION OF THE EMBODIMENT

It is intended by way of the flow diagram shown in FIG. 1 to elucidate the sequence of the method according to the invention for the case-hardening of higher-molybdenum-alloy sintered steels. In a first sintering step 10, the molybdenum-containing steel, which is present in powder form, is pressed to form a shaped body of any desired geometric shape. The molybdenum content of the steel is, for example, 3.5%. In a second method step 12, the sintering of the previously pressed shaped bodies subsequently occurs at a sintering temperature of 1250° C. During this process, the sintered material is disposed exclusively in the lattice structure region of the α-iron, as is explained by way of the phase diagram of molybdenum-containing sintered steels according to Höganäs shown in FIG. 2. Sintering occurs under a protective gas atmosphere, for example, under hydrogen or in a vacuum.

In a next method step 14, the previously sintered higher-molybdenum-alloy sintered steel is subjected to a further heat treatment at a temperature of, for example, approximately 1120° C. This heat treatment occurs while carbon-containing atmosphere is supplied. During this process, the sintered steel is advisably cooled down from the sintering temperature. The heat treatment thus occurs immediately after sintering.

At a temperature of 1120° C., approximately 40% of the material volume of the molybdenum-alloy sintered steel is disposed in the region of the γ-iron, as is illustrated again by the phase diagram in FIG. 2. This favors the pick-up of carbon from the ambient atmosphere into the lattice structure of the molybdenum-alloy sintered steel. The heat treatment carried out during method step 14 can be carried out very advantageously, for example, directly in the furnace in which the sintering takes place according to method step 12. With lesser portions of dissolved carbon in the molybdenum-alloy sintered steel, the remaining volume of the material also converts into the lattice structure of the γ-iron at the temperature of 1120° C. with which the heat treatment is carried out.

Depending on the desired application of the higher-molybdenum-alloy sintered steels treated by means of the method steps 10 to 14, these steels may then immediately be put to a use, here merely identified in general by 16. This is, for example, the mounting into certain machine parts for which the component properties suffice which are accomplished by means of the heat treatment with simultaneous supply of carbon according to process step 14.

If the component properties accomplished during method step 14 are not sufficient for the later application, a case-hardening of the higher-molybdenum-alloy sintered steel takes place in a next method step 18, which steel has previously been sintered and heat-treated according to method step 14. This case-hardening occurs at temperatures of 840° C. to 950° C. while the carbon-containing atmosphere or other carbon-releasing agents, which need not be considered here in detail, are supplied. Thus, the previous heat treatment according to method step 14 activated the molybdenum-alloy sintered steel so that, also below the lower temperatures prevailing here, the integration of carbon into the edge regions of the shaped body is possible by way of the case-hardening in method step 18 without resulting in the development of a brittle carbide network. Following the case-hardening in method step 18, the molybdenum-alloy sintered steel, which was treated overall according to the invention, can be used for a special application, again identified here by 16.

We claim:

1. A method for the case-hardening of higher-molybdenum alloy sintered steels having a molybdenum content of ≧2 wt %, characterized in that, immediately after sintering, the sintered steels are cooled down to a temperature range in which a minimum portion of γ-iron is present in the sintered steel and that the sintered steels are subjected to a heat treatment in this temperature range in the presence of carbon.

2. A method according to claim 1, characterized in that the heat treatment is carried out in a temperature range from 1050° C. to 1200° C., preferably 1120° C.

3. A method according to claim 1, characterized in that during the heat treatment the molybdenum-alloy sintered steels are acted upon by means of a carbon-releasing agent.

4. A method according to claim 1, characterized in that the sintered steel has a molybdenum content of 2 to 4 wt %, preferably of 3.5 wt %.

5. A method according to claims 1, characterized in that subsequent to the heat treatment a case-hardening is carried out at temperatures from 840° C. to 950° C.

* * * * *